United States Patent [19]

Reddy et al.

[11] 4,198,932

[45] Apr. 22, 1980

[54] ANTI-FLOOD CIRCUIT FOR USE WITH AN ELECTRONIC FUEL INJECTION SYSTEM

[75] Inventors: Junuthula N. Reddy, Troy; Gerald K. Flagg, Lathrup Village, both of Mich.

[73] Assignee: The Bendix Corporation, Southfield, Mich.

[21] Appl. No.: 901,403

[22] Filed: May 1, 1978

[51] Int. Cl.[2] ..... F02D 5/00

[52] U.S. Cl. ..... 123/32 EG; 123/179 G; 123/179 L

[58] Field of Search ..... 123/32 EG, 32 EK, 32 EA, 123/179 L, 179 B, 179 G, 179 A

[56] References Cited

U.S. PATENT DOCUMENTS

| | | | |
|---|---|---|---|
| 3,616,784 | 11/1971 | Barr | 123/32 EG |
| 3,628,510 | 12/1971 | Moulds et al. | 123/32 EG |
| 3,716,034 | 2/1973 | Schmid | 123/32 EG |
| 3,923,031 | 12/1975 | Keranen | 123/179 L |
| 3,982,519 | 9/1976 | Moon | 123/179 L |
| 4,027,641 | 6/1977 | Möder | 123/32 EA |
| 4,096,833 | 6/1978 | Sweet | 123/32 EA |
| 4,148,282 | 4/1979 | Grassle et al. | 123/179 L |

*Primary Examiner*—Ira S. Lazarus
*Assistant Examiner*—Andrew M. Dolinar
*Attorney, Agent, or Firm*—Russel C. Wells

[57] ABSTRACT

A pulse width computer for a fuel-injected internal combustion engine generates injector actuation control pulses, the widths of which increase with decreasing engine temperature. These actuation control pulses are normally applied to control an injector drive circuit that, in turn, controls the duration of activation of one or more electromagnetically-actuated injectors in synchronization with the engine cycle. During engine cranking operations, the widths of the injector actuation control pulses are also integrated on a capacitor to generate a voltage that is compared with a temperature dependent reference voltage selected to represent an incipient flood condition. When the capacitor voltage is detected as having increased to this reference voltage, the comparator causes an attenuation of the injector actuation control pulse. In one embodiment, the injector actuation control pulse is attenuated by being inhibited for the remainder of the cranking period after which the capacitor is suitably discharged. In another embodiment, the injector actuation control signal is inhibited until the capacitor is discharged at a predetermined rate to a level below the incipient flood level. And, in a third embodiment, the width of the injector actuation control signal is decreased by a one shot pulse the width of which varies with one or more engine parameters.

6 Claims, 5 Drawing Figures

TIMING DIAGRAM

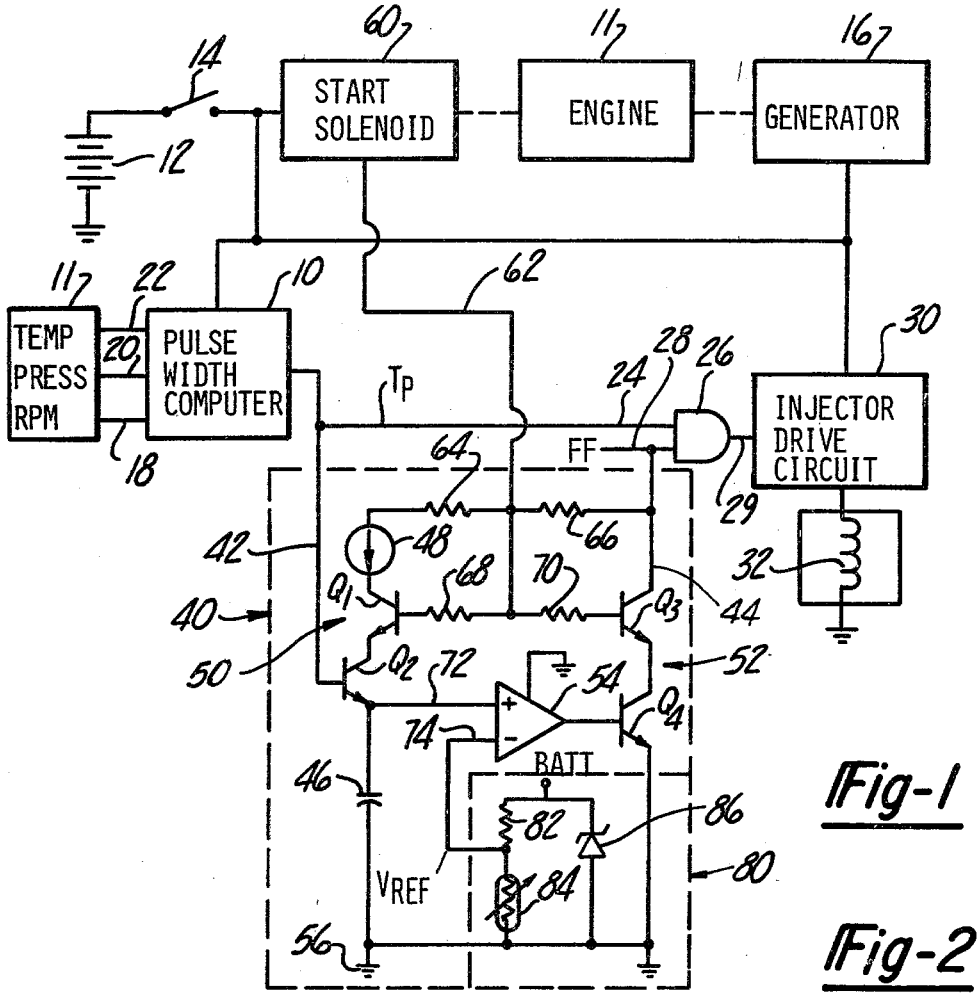
Fig-1
Fig-2
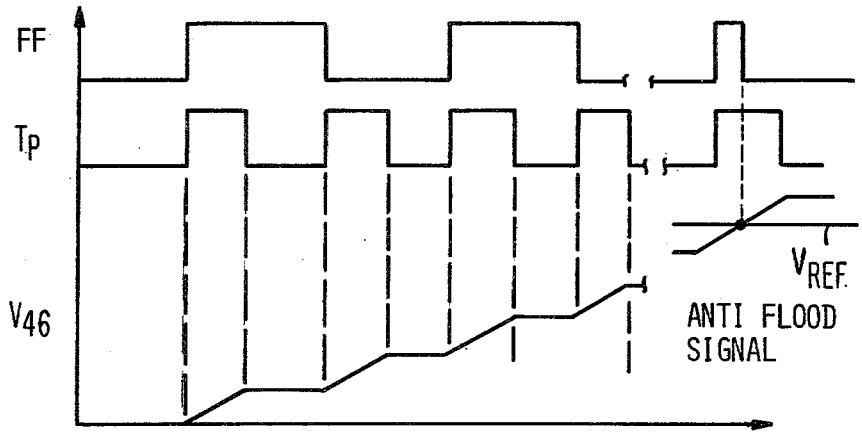
TIMING DIAGRAM

ANTI-FLOOD CIRCUIT FOR USE WITH AN ELECTRONIC FUEL INJECTION SYSTEM

RELATED CASE

This application is related to the commonly-assigned, concurrently-filed U.S. patent application Ser. No. 901,402.

FIELD OF INVENTION

This invention relates to circuits for reducing the risk of flooding a fuel-injected internal combustion engine while attempting to start it and particularly to that type of anti-flood circuit responsive to the widths of computed start pulses.

BACKGROUND

As well known to motorists, a flooded engine at the very least creates an inconvenience, often incurs a cost of road aid, and sometimes exposes the car and its passengers to unnecessary safety risks. This is in addition to the unnecessary degredation to the life and operation of the engine in the form of fouled spark plugs, cylinder walls washed of their lubricants, and accelerated engine wear due to breakdown of the lubricants themselves. It is therefore highly desirable to enhance engine starting operation while at the same time decreasing the risk of engine flooding.

Conventional spark-ignited internal combustion engines are cranked at about 30 RPM during starting which is markedly lower than the 600 RPM idling speeds when started. Therefore, less air is inhaled during starting resulting in poor fuel atomization, increased wetting of the walls of the intake manifolding by the raw fuel, and generally more marginal ignition conditions. Moreover, such effects become more pronounced with decreasing starting temperatures.

Conventionally, to compensate for these conditions, the air fuel mixture is enriched during cranking as a function of decreasing temperature and battery supply voltages. In the case of one conventional fuel injected eight cylinder engine, it has been found that, in order to start the engine within two seconds of cranking, the widths of the injected fuel pulses have to be extended from normal operating values of about 10 milliseconds to starting values of about 35 milliseconds when starting at −20° F.

As the widths of the start pulses increase so does the risk of flooding the engine. To minimize this risk, the starting pulses are calibrated to be leaner than optimum at each temperature, resulting in longer cranking times, greater expenditure of battery power, etc. To the extent that such longer cranking might consume all the effective cranking power, the engine might not start where it otherwise might have started. It is therefore desirable to start the engine using the richest mixture possible in the shortest cranking time.

The risk of flooding thus increases with decreasing temperature not only because of the required wide variation in the quantity of fuel required over the service range of temperatures but also because of the comparatively tight tolerance on the quantity of fuel required at each temperature. Moreover, since these quantities are based on assumed cranking speeds, the risk of flooding is further increased by factors affecting cranking speeds, such factors including variations in available battery voltages due to aging and temperature. It is therefore desirable to start an internal combustion engine using the richest fuel mixture possible without flooding the engine.

Compared to conventionally-carburetted internal combustion engines, those that are fuel injected experience an inherently lower risk of inadvertently flooding during starting. Such fuel injection systems include those disclosed in my commonly-assigned U.S. Pat. Nos. 3,734,068 and RE 29,060, the disclosures of which are hereby expressly incorporated herein by reference. As disclosed therein, the widths of the fuel pulses are closely tailored to general engine operating conditions, and, in particular, to cold start conditions. Moreover, even though very low battery voltages are still experienced when starting in cold weather, the effect of the resulting low supply voltages on the injector drive circuits may be reduced by using injector drive circuits of the type that use more of the available supply voltage to activate the injectors. Such injector drive circuits may be of the type that do not use the external resister conventionally connected series with each injector to protect it from an inadvertent short circuit. This type of circuit includes those disclosed in my commonly-assigned co-pending U.S. patent application Ser. No. 370,140 and U.S. Pat. No. 3,725,678 representing a continuation and division respectively of my now abandoned patent application Ser. No. 130,349 filed Apr. 1, 1971, the disclosures of each such case being hereby expressly incorporated herein by reference.

Finally, the risk of flooding may be further reduced by using fuel injectors effecting a finer and more uniform atomization. Such fuel injectors may be of the type disclosed in the commonly-assigned U.S. Pat. Nos. to Kiwior 4,030,668 and Kiwior et al 4,057,190, the disclosures of which are hereby expressly incorporated by reference.

However, even with such improved fuel injection systems, injector drive circuits, and fuel injectors, the electrical parameters of each system component may nevertheless shift with aging and temperature. Such shifts in electrical parameters could shift the widths of the computed start pulses outside their tolerances. As a result, injectors could stay open for the entire period available for fuel injection rather than just for the start pulse portion of such period that would have been computed if the parameters had not shifted and/or the battery supply dropped more than expected. To avoid the consequences of flooding, it is therefore desirable to detect an indication of incipient flooding in the form of the quantity of fuel injected during starting and then to use this information to either inhibit or otherwise attenuate further fuel injection.

As an example of one type of the latter circuit, the U.S. Pat. Nos. to Moulds et al 3,628,510 and Barr 3,616,784 both disclose a cranking enrichment circuit that adds constant-width enrichment pulses at a frequency varying inversely with engine temperature to conventionally computed variable width pulses generated in synchronization with engine rotation. Such variable-frequency constant-width enrichment pulses are added from the commencement of cranking when the charging of a capacitor is also commenced to when the capacitor voltage exceeds a predetermined reference. While the intervening time is an indication of the quantity fuel injected during each cranking interval, this time is at best only an approximation of the actual quantity of fuel injected. The approximation is based on the assumptions that there are no changes with temperature, age, etc. from the calibrated values of the frequency or widths of the basic fuel pulses to which the enrichment pulses are added, or even the basic cranking speeds. In other words, any unmatched shift in the values of these or other system parameters from their calibrated values increases the differences between the quantity of fuel actually injected during starting and the quantity that might be inferred from the time elapsed from beginning of cranking to when the capacitor voltage exceeds a reference threshold. Therefore, unless the Moulds/Barr reference threshold is set to include a sufficient margin of leanness from an incipient flood condition, the cranking enrichment circuits might not predict and prevent flooding in situations where flooding might otherwise occur. And even if the threshold were set with a sufficient margin of leanness, the resulting longer cranking times incurred might deplete the battery faster in the very cold start temperatures where flooding is most probable. In that case, the engine might not start, not because it has flooded, but because the remaining battery power is insufficient to adequately crank the engine.

It is therefore desirable to provide an anti-flood circuit utilizing a more direct indication of the quantity of fuel actually injected during cranking than the elapsed time from the beginning of cranking.

OBJECTS

It is therefore a primary object of the present invention to provide an anti-flood circuit that reduces the risk of flooding a fuel-injected internal combustion engine by utilizing an improved measurement of the actual quantity of fuel intended to be injected during cranking.

It is a further object of the present invention to provide an anti-flood circuit of the foregoing type wherein the widths of the start pulses provided to actuate the injector drive circuits during cranking are added to provide an indication of the quantity of fuel actually injected.

It is a further object of the present invention to provide an anti-flood circuit of the foregoing type wherein the actuation signal to the injector drive circuit is inhibited or otherwise attenuated when the sum of the successive start pulses exceeds an incipient flood reference level.

It is a further object of the present invention to provide an anti-flood circuit of the foregoing type wherein the sum of the successive start pulses is stored in storage means such as a capacitor or digital counter and wherein either the rate at which the sum is stored in such storage means or the incipient flood reference level varies with engine temperature.

And it is a further object of the present invention to provide an anti-flood circuit of the foregoing type wherein the contents of the storage means are decreased at a predetermined rate selected to permit injector actuation only after a predetermined elapsed time from the time the drive circuitry is inhibited, thereby allowing the intervening cranking of the engine to self-remove the potentially flooding quantity of fuel.

It is a further object of the present invention to provide an anti-flood circuit that decreases the time required to start a fuel-injected internal combustion engine at cold temperatures by using an improved measurement of the actual quantity of fuel to be injected in combination with a richer starting schedule of pulse width versus temperature.

SUMMARY OF INVENTION

A pulse width computer for a fuel-injected internal combustion engine generates injector actuation control pulses the widths of which increase with decreasing engine temperature. These actuation control pulses are normally applied to control an injector drive circuit that, in turn, controls the duration of activation of one or more electromagnetically-actuated injectors in synchronization with the engine cycle. During engine cranking operations, the widths of the injector actuation control pulses are also integrated on a capacitor to generate a voltage that is compared with a temperature dependent reference voltage selected to represent an incipient flood condition. When the capacitor voltage is detected as having increasing to this reference voltage, the comparator causes an attenuation of the injector actuation control pulse. In one embodiment, the injector actuation control pulse is attenuated by being inhibited for the remainder of the cranking period after which the capacitor is suitably discharged. In another embodiment, the injector actuation control signal is inhibited until the capacitor is discharged at a pre-determined rate to a level below the incipient flood level. And, in a third embodiment, the width of the injector actuation control signal is decreased by a one shot pulse the width of which varies with one or more engine parameters.

These and other objects and features of my invention will become more apparent by reference to the following detailed description when considered in conjunction with the above incorporated disclosures and the accompanying figures wherein.

FIGURES

FIG. 1 illustrates, partially in schematic and partially in block form, a fuel injection system incorporating the principles of my invention;

FIG. 2 is a timing diagram of certain waveforms useful in understanding the principles of the invention;

Figure 3:
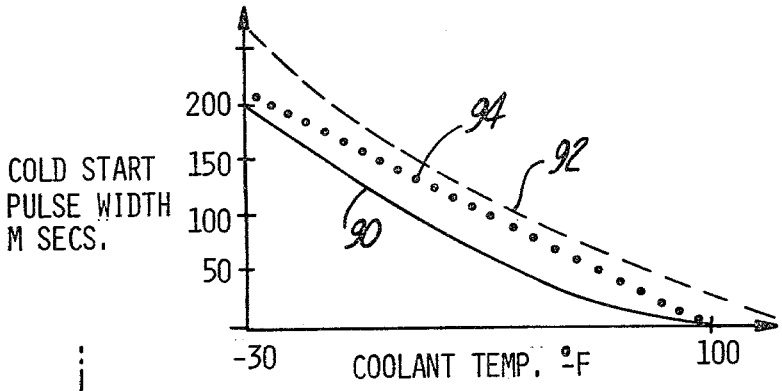
FIG. 3 illustrates empirical curves of the widths of start pulses versus engine coolant temperatures.

With reference now to FIG. 1, there is shown a pulse width computer 10 for computing one of a series of successive injector actuation control pulses $T_p$ in a predetermined synchronization with an event in the rotation of an internal combustion engine 11. During engine cranking operations, pulse width computer 10 is suitably energized with power from a vehicle battery 12 as enabled by the closure of an ignition switch 14. After the engine has started, pulse width computer 10 is suitably energized from a conventional vehicle generator 16.

Each actuation control pulse $T_p$ comprises a width computed to vary in a predetermined manner with one or more engine operating parameters as sensed by such sensors including an engine speed sensor 18, an engine manifold air pressure sensor 20, and engine water and/or oil temperature sensor 22. Preferably, pulse width computer 10 is either of the digital type disclosed in the commonly-assigned U.S. Pat. No. 3,964,443 to Hartford or the analog type disclosed in my above-incorporated U.S. Pat. No. 29,060, which avoids the use of totally independent circuitry for commanding cold starting and initial warm-up. However, such means could also comprise cold start circuits of the type disclosed in commonly-assigned U.S. Pat. Nos. to Luchaco et al 3,971,354; Rachel 3,646,915, Nagy 3,646,917; Nagy 3,646,918; and in the commonly-assigned U.S. application Ser. No. 752,376 filed for Marchak et al on Dec. 20, 1976, the disclosures of each such above-cited commonly-assigned case being hereby incorporated herein by reference. Similarly, pressure sensor 20 and temperature sensor 22 may be conventional or of the types disclosed respectively in my co-pending commonly-assigned U.S. patent applications Ser. Nos. 739,400 filed Nov. 18, 1976 and 857,559 filed Dec. 5, 1977, the disclosures of which are also hereby expressly incorporated herein by reference.

The injector actuation pulses $T_p$ are applied as one input 24 to a two input AND gate 26. Coupled to the second input 28 of gate 26 are one or more timing and selection signals FF. For example, in the case of the two-group multiple point injection system of the type disclosed in my above-incorporated U.S. Pat. No. Re. 29090 wherein each of two groups of cylinders are injected at two different times, the injector actuation signal $T_p$ would be of the type generated at circuit location 174 and the ANDed timing signal could be the distributor-developed flip-flop signal FF as applied to AND gate 46 or 48. In the case of single point system having just one primary injector or a simultaneous double fire system, the ANDed timing signal could be determined by a particular engine event such as the opening of an intake valve plus an advance therefrom corresponding the transport delay from the injector to the intake valve prior to its opening.

When so inputted, AND gate 26 transmits at output 29 the control pulse $T_p$ to a suitable injector drive circuit 30. Being suitably energized during cranking from battery 12 through ignition switch 14 and after starting from generator 16, injector drive circuit 30 is operative to actuate fuel injector means 32 in the form of one or more properly-selected electromagnetically-operated injection valves for a duration corresponding closely to the duration of injector actuation control signal $T_p$. While injector drive circuit 30 could be of any conventional type including virtually any type of amplifier capable of providing and controlling current to fuel injector means 32, the injector drive circuit 30 preferably comprises circuitry of the type disclosed in my above-incorporated application No. 370,140 or in the U.S. Pat. No. 3,734,344, to Davis et al the disclosures of which are also hereby expressly incorporated herein by reference.

Finally, injector means 32 could comprise virtually any conventional electromagnetically-operated injector valve capable of operating in the environment of an internal combustion engine to deliver precise quantities of fuel at a suitable location, including directly into a throttle bore upstream or downstream of a throttle blade or into the intake manifolds leading to banks of cylinders, or into each cylinder itself. Preferably, however, injector valve means 32 comprise at least one of the injector valves and fuel break-up means disclosed in the above-incorporated U.S. Pat. Nos. to Kiwior and Kiwior et al respectively 4,030,688 and 4,057,190. These electromagnetic injection valves effect a smooth through-flow of fuel effecting a metering precision reducing the margin of leanness otherwise required to protect against flooding in cold starts. These injection valves also break up the fuel into droplets so small and uniform as to enhance the combustibility of the resulting spray during cold starts.

The present invention contemplates coupling an anti-flood circuit 40 intermediate the above-described pulse width computer 10 and injector drive circuit 30. In the preferred embodiment, the anti-flood circuit 40 is coupled across inputs 24 and 28, of AND gate 26 respectively by conductors 42 and 44 and generally comprises content storage means 46, a constant current source 48, first logic means 50, second logic means 52, and comparator means 54.

The first logic means 50 are here in a form including a pair of NPN transistors $Q_1$ and $Q_2$ connected so that the $Q_2$ base is coupled by conductor 42 to the $T_p$ input 24 of AND gate 26 and so that the $Q_1$ and $Q_2$ collector-to-emitter junctions are coupled to form a series pass circuit between one side of constant current source 48 and the ungrounded side of capacitor 46, the grounded side of which is connected to ground 56. The second logic means 52 are here in a form including AND gate 26, and a second pair of transistors $Q_3$ and $Q_4$ connected so that the $Q_3$ collector is coupled by conductor 44 to the timing input 28 of AND gate 26, so that $Q_4$ base is coupled directly to the output of comparator 54, and so that the $Q_3$ and $Q_4$ collector-to-emitter junctions are coupled to form a series pass circuit between timing input 28 and ground 56.

To enable current source means 48 and the first and second logic means 50 and 52 to be operative only when the engine is cranked, anti-flood circuit 40 further comprises a conductor 62 connected to a pair of contacts (not shown) of a conventional start solenoid 60 adapted to output a start solenoid signal SS. These contacts are closed to provide the SS output as long as ignition switch 14 is closed to a start position wherein start solenoid 60 conventionally actuates a conventional cranking motor (not shown) to conventionally crank the ring gear (not shown) of the engine 11 until started. When thus provided on conductor 62, the start solenoid signal SS is also coupled by resistor 64 to the other side of current source 48, by resistor 66 to the collector of transistor $Q_3$, and by resistors 68 and 70 respectively to the bases of transistors $Q_1$ and $Q_3$.

Comparator 54 has a non-inverting input 72 coupled to the ungrounded side of capacitor 46 and an inverting input 74 coupled to incipient flood reference means 80 providing a reference voltage for comparison with the voltage on capacitor 46. In the preferred embodiment, the reference means 80 comprise a voltage divider including a resistor 82 and a temperature sensor 84 that senses the temperature of the engine and produces a resistance decreasing linearly with increasing engine temperatures. Temperature sensor 84 which may also be of the type disclosed in my above-incorporated application Ser. No. 857,559 is coupled across a constant voltage provided by a Zener diode 86 coupled between the battery 12 and ground 56. The reference input 74 of comparator 54 is coupled to the node between resistor 82 and temperature sensor 84. The relative values of resistor 82 and sensor 84 are selected so that the voltage at the node therebetween provides reference input 74 of comparator 54 with an incipient flood reference voltage, the magnitude of which is selected in a manner to be described shortly.

In operation of the embodiment illustrated in FIG. 1, transistors $Q_1$ and $Q_3$ are saturated whenever suitable forward biased by a start solenoid signal SS and are blocked in the absence of the start solenoid signal. As may be better understood with reference to the waveforms shown in FIG. 2, transistors $Q_2$ and $Q_4$ are saturated whenever suitable forward biased respectively by an injector actuation control pulse $T_p$, and a HIGH level output from comparator 54. Comparator 54 conventionally provides such HIGH level output whenever the voltage at its noninverting input 72 exceeds that at its inverting input 74 and otherwise produces a LOW level output sufficient to block transistor $Q_4$.

Therefore, whenever ignition switch 14 is closed to its start position, constant current source 48 charges capacitor 46 with constant current for the duration of each injector actuation control pulse $T_p$ generated by pulse-width computer 10. This control pulse $T_p$ enables both AND gate 26 by being applied to one input thereof and also enables logic means 50 by being coupled by conductor 42 to the base of transistor $Q_2$ thereof.

Whenever a distributor or ignition coil actuated trigger also produces the FF timing signal, on the second or timing input 28 of AND gate 26, this AND gate also transmits via its output 29 the control pulse $T_p$ to the injector drive circuit 30 to cause a corresponding actuation injector 32. However, during cranking this timing signal may be inhibited by the operation of anti-flood circuit 40 to thereby prevent the actuation of injector 32 even though pulse-width computer 10 generates a control pulse $T_p$. To do this, transistors $Q_1$ and $Q_3$ of logic means 50 and 52 respectively are enabled with the battery voltage applied to their bases through the closure of ignition switch 14 to its cranking position. Thereupon, the control pulses $T_p$ render both transistors $Q_1$ and $Q_2$ fully conductive to allow these first logic means 50 to conduct charging current from constant current source 48 to capacitor 46.

Each control pulse $T_p$ generated from the commencement of cranking causes capacitor 46 to charge, and the resulting increasing capacitor voltage is coupled to the sense input 72 of comparator 54. When the capacitor voltage increases to the reference voltage, $V_{REF}$ provided to reference input 74 by reference means 80, comparator 54 provides a HIGH level output to the base of transistor $Q_4$ of the second logic means 52. Thereupon transistor $Q_3$ and $Q_4$ cooperate to ground the FF timing signal that would otherwise cause AND gate 26 to pass an injector actuation control pulse to injector drive circuit 30.

The transmission of injector control pulses $T_p$ to injector drive circuit 30 is thereafter inhibited through transistor $Q_3$ and $Q_4$ until the later of the opening of ignition switch 14 from its cranking position or the discharge of capacitor 46 below the incipient flood reference level at the inverting input 74 of comparator 54.

The anti-flood circuit of the present invention thus cooperates with the above-described elements of a fuel injection system to indicate the quantity of fuel actually injected during cranking and to provide an output used to reduce the risk of flooding when the quantity of fuel actually injected increases to an incipient flood level. This incipient flood level varies with at least temperature and is one that may be determined for each different type of internal combustion engine.

The incipient flood level $Q_{IF}$ is selected as a quantity of fuel greater than that normally required to start the engine at each temperature $Q_S$ and less that that found to flood it $Q_F$. With reference to FIG. 3, these quantities may be readily determined experimentally for each engine by slowly increasing the widths of the start pulses and counting the engine revolutions to where the engine just starts at each temperature (solid line 90) and then increasing the start pulse still further to where the engine no longer starts (dashed line 92) presumably because it has "flooded." The incipient flood level (dotted line 94) may then be fitted between these start and flood values in the form of a straight line selected to correspond to and be represented by the linear output characteristics of temperature sensor 84.

But, in general, $$Q_F = Q_I \times N \times T_{FP} \times R_F$$

and $$Q_S = Q_I \times N \times T_{SP} \times R_S$$

where $T_{FP}$ and $T_{SP}$ are the respective widths of the start pulses found to just flood and just start the engine;

$R_F$ and $R_S$ are the respective number of engine revolutions observed in just flooding and just starting the engine;

N is the number of cylinders injected with each start pulse; and $Q_I$ is the flow rate of each injector under operating conditions.

Therefore $$Q_F - Q_S = Q_I \times N(T_{FP}R_F - T_{SP}R_S)$$

and $Q_{IF}$ may be readily calculated from $$Q_{IF} = Q_I \times N + T_{SP} \times R_S + K_F \cdot {}_S Q_I N(T_{RP}R_F - T_{SP}R_S)$$

where $K_{FS}$ is a fail safe factor causing $Q_{IF}$ to be intermediate to $Q_S$ and $Q_F$.

For example, one eight-cylinder engine wherein fuel was injected into four cylinders at a time once each revolution was found to normally start within one revolution and to flood within 10 revolutions at most temperatures when injected with injectors operated from a 14 volt supply and having an operational flow rate $Q_I$ of about 385 cc/min. At 0° F. this engine normally started with pulse widths of about 160 milliseconds. Therefore $$Q_S = 385 \frac{\text{cc}}{\text{min}} \times \frac{1}{60} \frac{\text{min}}{\text{sec}} \times 8 \text{ cyl} \times 0.160 \frac{\text{sec}}{\text{rev}} \times 1 \text{ rev} = 8.2 \text{ cc}$$

Then, arbitrarily setting $K_{FS}$ at 0.5 so that $Q_{IF}$ is midway between $Q_S$ and $Q_F$, $$Q_{IF} = 8.2 \text{ cc} + 0.5 \times 385 \frac{\text{cc}}{\text{min}} \times \frac{1}{60} \frac{\text{min}}{\text{sec}} 8 \frac{\text{cyl}}{\text{eng}} (0.200 \frac{\text{sec}}{\text{rev}} \times 10 \text{ rev} - 0.160 \frac{\text{sec}}{\text{rev}}) = 8.2 \text{ cc} + 47.5 \text{ cc} = 55.7 \text{ cc}$$

The present invention of course contemplates other methods of ascertaining and utilizing other direct indicators of the actual quantity of fuel delivered and other indications of the incipient flood quantity. Moreover, the content storage means 46 could comprise other forms including a digital register the input to which could be logically combined with a conventional clock to increase the contents of the register for the duration of the input pulse width. Similarly, the first or second logic means 50 and 52 could comprise other logic forms. For example, transistor $Q_1$ could be replaced by merely coupling the constant current source 48 directly to the collector of transistor $Q_2$ so as to enable the above-mentioned contacts of the start solenoid perform the otherwise redundant logic function of $Q_1$.

Similarly, it may be preferable in some applications to fix the reference input 74 to comparator 54 and then decrease the magnitude of the current provided by current source 48 with decreasing engine temperature using a current source such as current source $I_2$ in my above-referenced reissue patent. In this manner, start pulses of the same duration would charge capacitor 46 at rates which would decrease with decreasing temperature so that a greater number of constant width start pulses would be required with decreasing temperatures before increasing the capacitor voltage to the now-fixed reference. The net effect would then be to make the start pulse integrated by capacitor 46 doubly dependent on decreasing engine temperatures since now both its width would increase therewith as disclosed in my above-incorporated reissue patent and its magnitude would now also decrease therewith.

As has been indicated with the anti-flood circuit shown in FIG. 1, the transmission of the injector actuation pulse $T_p$ is inhibited for the later-to-occur of the decay of capacitor 46 below the incipient flood reference voltage at input 74 or the release of the ignition switch 14 from its crank position. The decay rate for the charge on the capacitor 46 is fixed in the FIG. 1 circuit since the decay path includes the ground connection normally coupled to comparator 54 as well as that grounded side of the capacitor.

FIGURE 4 EMBODIMENT

The effect of this fixed decay rate is to allow the capacitor 46 to continue charging above the incipient flood reference voltage 74 with each injector actuation pulse $T_p$ for the remainder of the cranking period even though AND gate 26 no longer transmits these pulses to the injector drive circuit 30 and drive circuit 30 no longer actuates injector 32. In other words, resumption of delivery of fuel pulses to injector 32 is delayed as a function of the fixed decay rate of capacitor 46 and the amount of time that the driver continues "dry" cranking after the incipient flood reference voltage is exceeded. A certain amount of such dry cranking is desirable to allow the engine to purge the excess quantity of fuel that might otherwise flood it. However, to prevent undue expenditure of battery energy in such situations, it may be desirable to fix or otherwise limit the amount of dry cranking by selectively activating an auxilliary discharge circuit 100 which may, for example, be of the type illustrated in FIG. 4 coupled across capacitor 46.

Figure 4:
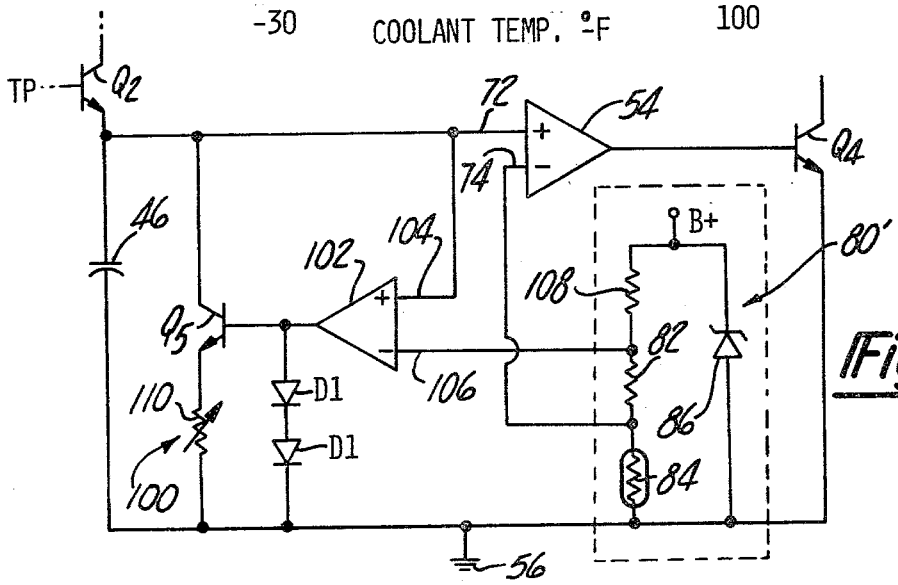
FIG. 4 illustrates in schematic form one alternative modification for discharging the pulse width integrating capacitor of the FIG. 1 embodiment at a predetermined rate.

As may be better understood with reference to FIG. 4, wherein components identical to those shown and described with respect to FIG. 1 are similarly identified, auxilliary discharge circuit 100 comprises a comparator 102 having a non-inverting input 104 coupled to the non-grounded side of capacitor 46. The inverting input 106 of comparator 102 is coupled to a reference circuit 80' modified from reference circuit 80 to include an additional resistor 108 providing at a node with resistor 82 a reference voltage floating above that at reference input 74 of comparator 54 by an amount increasing with decreasing engine temperatures so that the engine will be dry cranked longer with decreasing temperatures. The output of comparator 102 is coupled to the base of an NPN discharge transistor $Q_5$, the collector of which is coupled to the non-grounded side of capacitor 46 and the emitter of which is coupled to ground 56 by a variable resistor 110. Fixed voltage providing means in the form of a pair of diodes $D_1$ and $D_2$ are in series from the base of transistor $Q_5$ to ground 56. These diodes cooperate with the resistance selected for variable resistor 110 to discharge capacitor 46 at a predetermined linear rate whenever comparator 102 produces a HIGH output in response to a voltage across capacitor 46 in excess of the voltage at reference input 106.

FIGURE 5 EMBODIMENT

As another alternative to an indefinite period of dry cranking after the incipient reference voltage has been exceeded, it may be desirable to reduce the transmission of injector actuation pulses by decreasing their width rather than by inhibiting their transmission altogether as would be the case with the embodiment shown in FIG. 1. For this purpose, the anti-flood circuit 40 shown in FIG. 1 may be modified to include a pulse shrink circuit 120 which may be of the type shown in FIG. 5.

Figure 5:
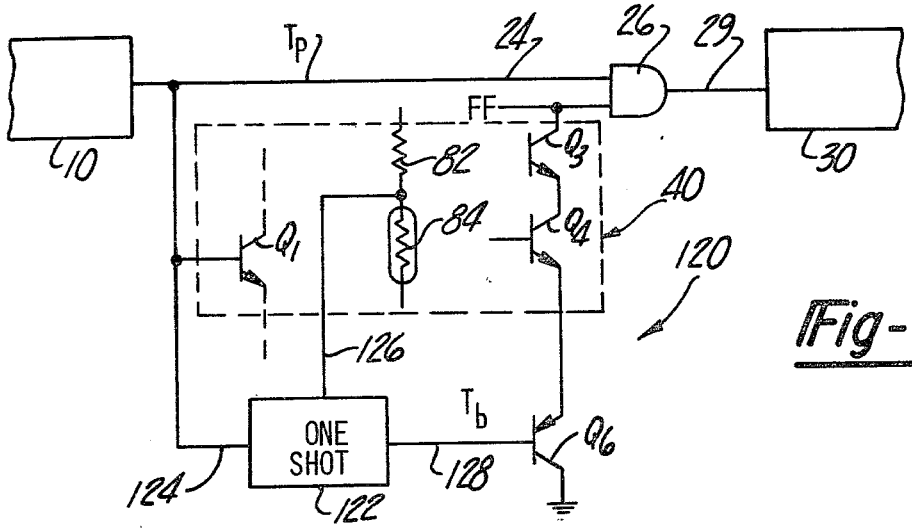
FIG. 5 illustrates, partially in schematic and partially in block form, another alternative modification for attenuating the injector actuation control signal generated by the pulse width computation device of FIG. 1.

As may be better understood with reference to FIG. 5 wherein components identical to those shown and described with respect to FIG. 1 are similarly identified, pulse shrink circuit 120 comprises a conventional one shot monostable multivibrator 122 that responds to the leading edge of each $T_p$ injector actuation pulse to produce an output blocking pulse $T_b$ having a width smaller than each initiating $T_p$ pulse. To generate this blocking pulse $T_b$, monostable 122 has a first input 124 coupled to said pulse width computer 10 and a second input 126 coupled to temperature sensor 84. The parameters of the components comprising monostable 122 are selected in a known manner to generate at an output 128 thereof a blocking pulse commencing with each initiating injector actuation pulse $T_p$, ending before the end of each initiating $T_p$ pulse, and having width varying with temperature in the same manner as the $T_p$ pulse varies with temperature. The output 128 of one shot 122 is coupled to the base of a PNP transistor $Q_6$ inserted in the $Q_3$–$Q_4$ series-pass circuit between timing input 28 of AND gate 26 and ground 56.

In operation of pulse shrink circuit 120, monostable 122 responds to the leading edge of each $T_p$ pulse to produce at output 128 a blocking pulse $T_b$ blocking PNP transistor $Q_6$ and thereby interrupting for the width of the blocking pulse $T_b$ the $Q_3$–$Q_4$ series-pass circuit that would otherwise in the presence of an incipient flood output inhibit the operation of AND 26 to transmit the $T_p$ pulses to injector drive circuit 30. Since the width of the blocking pulse from monostable 120 is selected to be less than, and track that of, each injector actuation pulse $T_p$ at each temperature, AND gate 26 is disabled for only that portion of each $T_p$ pulse represented by the "shrunken" difference $T_s$ between the width of each $T_p$ pulse and each blocking pulse $T_b$ generated in response thereto.

Thus, even though the incipient flood level might have been exceeded, fuel would still be injected during cranking using injector actuation pulse $T_p'$ having a width modified from that of computed actuation pulse $T_p$ by an amount determined by the difference therefrom of the blocking pulse $T_b$ generated by monostable 122 which is the FIG. 5 embodiment, the presence of a blocking pulse enables the transmission of the actuation pulse when such transmission would otherwise have been disabled and disables such transmission for the remainder of the $T_p$ pulse, other forms of modifying the width of the $T_p$ pulse are contemplated. For example, by using an NPN transistor for $Q_6$, the positive going output from monostable 122 would disable AND gate 26 for the duration of the blocking pulse $T_b$ and would thereafter permit transmission.

CONCLUSION

Having described the features and certain alternative modifications of the invention, it is understood that the specific terms and examples are employed as a descriptive sense only and not for the purpose of limitation. Other embodiments of the invention, modifications thereof, and alternatives thereto will be obvious to those skilled in the art without departing from the invention. The appended claims therefore aim to cover the modifications and changes that are within the true spirit and scope of the invention.

What is claimed is:

1. In a fuel management system for a fuel-injected internal combustion engine comprising engine cranking means providing a cranking signal while the engine is being cranked, at least one electromagnetically actuatable fuel injection valve means, engine synchronization timing generator means for generating a timing signal synchronizing the operation of the injector means with an event in an engine revolution, temperature sensor means providing a temperature dependent signal having a magnitude varying with engine temperature, pulse-width computing means providing a series of variable width injector-actuation pulses, and injector drive circuit means normally operative to actuate the fuel injection valve means for periods corresponding to the widths of the injector actuation pulses transmitted thereto, anti-flood means for reducing the flow of fuel to the engine during cranking characterized by (a) fuel content storage means operative to store a fuel signal representing the magnitude of the quantity of fuel supplied to the engine during cranking;

(b) variation means adapted to be coupled to said fuel content storage means to vary said fuel signal at a predetermined rate;

(c) first logic means coupled to said fuel content storage means, to said variation means, to the pulse width computing means and to the engine cranking means, said first logic means being operative to couple said variation means and said fuel content storage means during an injector actuation pulse generated in the presence of the cranking signal;

(d) reference means providing a reference signal;

(e) comparator means having a first input coupled to said fuel content storage means and a second input coupled to said reference means; said comparator means providing an incipient flood output signal when the magnitude of said fuel signal exceeds the magnitude of said reference signal; and (f) second logic means comprising first AND gate means having a first input coupled to the pulse width computing means, a second input coupled to the timing signal generating means, and an output coupled to the injector drive circuit means, second AND gate means having a first input coupled to said comparator means output, a second input coupled to the cranking means, and an output coupled to said second input of said first AND gate means, said second logic means being operative to control the injector drive circuit when said comparator means provides said incipient flood output signal in the presence of the cranking signal.

2. The anti-flood means of claim 1 further comprising blocking pulse generating means having an input coupled to the pulse width computing means and an output coupled to said second logic means, said blocking pulse generating means being responsive to one of the injector actuation pulses to generate a blocking pulse having a width difference from the width of the injector actuation pulse and whereby said second logic means controls the injector drive circuit in accordance with said width difference.

3. The anti-flood means of claim 2 wherein the temperature sensor means is coupled to said blocking pulse generator means to cause said blocking pulse generating means to generate a blocking pulse having a width varying with engine temperature.

4. The anti-flood means of claim 2 wherein said second logic means reduces the width of the injector actuation pulse transmitted to the injector drive circuit by preventing the transmission of the injector actuation pulse for one of the duration of said blocking pulse and said width difference in the widths of the injector actuation pulse and said blocking pulse.

5. The anti-flood means of claim 1 wherein said reference means is coupled to the temperature sensor means to provide a first temperature dependent reference signal coupled to said second input of said comparator and a second temperature dependent reference signal.

6. The anti-flood means of claim 5 further comprising second variation means comprising second comparator means having a first input coupled to said fuel content storage means and a second input coupled to said reference means, said second variation means operative to vary said fuel signal at a second predetermined rate when the said fuel signal has a magnitude in excess of the value of the magnitude of said second temperature dependent reference signal.

* * * * *